US006299552B1

(12) United States Patent
Morgan et al.

(10) Patent No.: US 6,299,552 B1
(45) Date of Patent: Oct. 9, 2001

(54) LOW DRAG AND WEIGHT GOLF BALL

(75) Inventors: William E. Morgan, Barrington, RI (US); Herbert C. Boehm, Norwell; Steven Aoyama, Marion, both of MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 09/294,401

(22) Filed: Apr. 20, 1999

(51) Int. Cl.[7] ..... A63B 37/12; A63B 37/14

(52) U.S. Cl. ..... 473/384; 473/354; 473/365; 473/377; 473/385

(58) Field of Search ..... 473/354, 365, 473/377, 384, 385

(56) References Cited

U.S. PATENT DOCUMENTS

| | | | | |
|---|---|---|---|---|
| 4,560,168 | | 12/1985 | Aoyama | 273/232 |
| 4,720,111 | * | 1/1988 | Yamada | 273/232 |
| 4,804,189 | * | 2/1989 | Gobush | 273/232 |
| 4,858,923 | | 8/1989 | Gobush et al. | 273/62 |
| 4,915,309 | | 4/1990 | Gobush et al. | 273/232 |
| 5,005,838 | * | 4/1991 | Oka | 273/232 |
| 5,209,483 | * | 5/1993 | Gedney | 273/187.4 |
| 5,467,994 | * | 11/1995 | Moriyama | 273/222 |
| 5,601,503 | * | 2/1997 | Yamagishi | 473/384 |
| 5,827,167 | * | 10/1998 | Dougan | 473/356 |
| 5,846,141 | * | 12/1998 | Morgan | 473/377 |
| 5,857,924 | * | 1/1999 | Miyagawa | 473/365 |
| 5,890,974 | * | 4/1999 | Stiefel | 473/384 |
| 5,890,975 | * | 4/1999 | Stiefel | 473/384 |
| 5,935,023 | * | 9/1999 | Maehara | 473/384 |
| 5,957,787 | * | 9/1999 | Hwang | 473/379 |

* cited by examiner

*Primary Examiner*—Lee Young
*Assistant Examiner*—Paul D. Kim
(74) *Attorney, Agent, or Firm*—Pennie & Edmonds LLP

(57) ABSTRACT

A golf ball that has a core and a cover surrounding the core. The cover has an exterior surface which defines a plurality of dimples dimensioned and arranged such that the golf ball has a coefficient of drag below about 0.26 at a Reynolds number of about 150,000 and a spin rate of about 3000 rpm. The cover and the core are made from materials selected such that the golf ball has a weight of below about 1.60 oz.

26 Claims, 6 Drawing Sheets

LOW DRAG AND WEIGHT GOLF BALL

BACKGROUND OF THE INVENTION

Golf balls are typically constructed of a single or multilayer core that is tightly surrounded by a single or multilayer cover. It is typical for a golf ball core to be of solid construction or wound construction. A solid core commonly comprises polybutadiene, and a wound core typically comprises rubber threads tightly wound around a solid or liquid center. The methods for forming these cores are well known in the art. Traditionally, golf ball covers are made of polymeric materials. For instance, covers have been made of balata rubber, which may be natural balata, synthetic balata or a blend of natural and synthetic balata, or ionomers such as those sold under the trademark SURLYN®.

The Rules of Golf as approved by the United States Golf Association (USGA), includes the following rules that relate to golf ball construction:

a. Weight

The weight of the ball shall not be greater than 1.620 ounces avoirdupois (45.92 gm).

b. Size

The diameter of the ball shall be not less than 1.680 inches (42.67 mm). This specification will be satisfied if, under its own weight, a ball falls through a 1.680 inches diameter ring gauge in fewer than 25 out of 100 randomly selected positions, the test being carried out at a temperature of 23+/−1° C.

c. Spherical Symmetry

The ball must not be designed, manufactured or intentionally modified to have properties which differ from those of a spherically symmetrical ball.

d. Initial Velocity

The velocity of the ball shall not be greater than 250 feet (76.2 m) per second when measured on apparatus approved by the United States Golf Association. A maximum tolerance of 2% will be allowed. The temperature of the ball when tested will be 23+/−1° C.

e. Overall Distance Standard (ODS)

A brand of golf ball, when tested on apparatus approved by the USGA on the outdoor range at the USGA Headquarters under the conditions set forth in the Overall Distance Standard for golf balls on file with the USGA, shall not cover an average distance in carry and roll exceeding 280 yards (256 m) plus a tolerance of 6%.

The Initial Velocity rule test is well known. The test is conducted by conditioning a ball for a minimum of 3 hrs at 23±1° C. The room in which the test is to be conducted is conditioned to 23±2° C. The ball is then struck by a striking mass of approximately 250 lbs at a striker velocity of 143.8 ft/sec.

The Overall Distance Standard test for golf balls is also well known and is conducted by striking the golf ball with a golf club having a lie of 55±2, a D2±1 swing weight, 11±10 loft angle, 13.3±1 oz. overall weight, 4.6±0.3 cycle per second vibrational frequency, 162±30 oz. in. moment of inertia, 43.5±0.2 inches club length, a laminated head construction, a cycolac insert, a stiff steel shaft, and an all-weather rubber grip. The club head velocity during the ODS test is about 160±0.5 ft/sec measured at the hosel of the club over the last 4 inches of travel prior to impact. The distance traveled is adjusted for zero wind and an ambient temperature of 75° F. The setup of the specially designed mechanical-golfer apparatus of the ODS test generally produces an initial ball velocity of 225–235 fps, a launch angle of 8°–11°, and a spin rate of 2300 to 3000 rpm using a known calibration ball.

The flight of a golf ball is determined by many factors, but only three factors that are typically controlled by the golfer. By impacting the ball with a golf club, the golfer typically controls the speed of the golf ball, the launch angle, and the spin rate. The launch angle sets the initial trajectory of the golf balls flight. The speed and spin of the ball give the ball lift which will define the balls overall flight path along with the weight and drag of the golf ball. Where the ball stops after being struck by a golf club also depends greatly on the weather and the landing surface the ball contacts.

Many golfers have what is termed a "low swing-speed." This means that the club head speed at impact is relatively slow when compared to that of a professional golfer. Typically, an average professional can drive a golf ball at a speed of approximately 235 fps (160 mph). A person having a low swing speed typically drives the ball at a speed of less than 176 fps (120 mph). Most golfers today have swing speeds that produce drives of less than 210 yards. A person with a low swing speed generates a low ball speed. His or her ball does not fly very far due to the lack of speed and lift.

Low weight golf balls have been suggested in the past, such as the Cayman Golf Company's SPECTRA™, the Ram LASER LIGHT®, the Maxfli MD-80 and MD-90, and the Pinnacle EQUALIZER®, which weighs 1.55 oz. and has a hard core and a standard cover with 392 dimples. Low weight golf balls such as these have been made to increase the lift to weight ratio of the golf ball, increasing the effects of the lift on ball trajectory, and also to produce a greater initial velocity upon impact than a heavier ball. It is generally known that low weight golf balls slow down faster than normal weight golf balls due to drag, an effect which is magnified at higher speeds. As a result, low weight balls have been designed to increase the lift to weight ratio, but not particularly to decrease the effect of drag.

Attempts have been made in the past to minimize drag, but these attempts have been focused only within a narrow window optimized for higher swing-speed ball flight. Conventional dimple patterns optimize lift to create the best trajectory for maximizing distance. These conventional dimple designs, however, are aerodynamically optimized for higher swing speeds than low swing-speed players can achieve. Generally, as the lift of a dimple pattern increases, drag also increases.

The advantages of a high spin, high lift golf ball are minimized at the low air speeds achieved by a ball hit by low swing-speed player. Since lift force increases with the square of the ball speed, ball speed has a greater effect than ball spin in creating lift, which produces a higher trajectory. When a player strikes a ball, a portion of the energy from the club head is transferred to the ball as ball speed, and another portion of the energy is transferred to the ball as ball spin. Players with low club swing speed necessarily will have less energy available to transfer to both ball speed and ball spin. When club speed becomes very low, the resulting ball speed can be low enough that the effect of ball spin does not significantly increase lift force. When the lift force exceeds the weight of the ball, the flight of the ball is described as "aerodynamic." When the lift is less than the weight of the ball, the ball flight is described as "ballistic." Aerodynamic flight can generally be optimized by balancing the relationship between ball speed, ball spin, and the aerodynamic effect of the dimples. Ballistic flight can generally be optimized by increasing the ball velocity, as a lift modifying effect of the dimples is minimized. When compared to a ball hit by a high swing-speed player, a similar ball that is hit by a low swing-speed player travels along a more ballistic trajectory than the aerodynamic trajectory achieved with a higher energy of a high swing-speed player.

The dimples on a golf ball play an important part in reducing drag and affecting lift. Drag is the air resistance that acts on the golf ball in the opposite direction from the ball's flight direction. As the spinning ball travels through the air, the air surrounding the ball has different velocities and, thus, different pressures. The air exerts maximum pressure at the stagnation point on the front of the ball. The air then flows over the sides of the ball and has increased velocity and reduced pressure. At some point it separates from the surface of the ball, leaving a large turbulent flow area behind the ball called the wake, which has low pressure. The difference between the high pressure in front of the ball and the low pressure behind the ball slows the ball. This is the primary source of drag for a golf ball.

The dimples on the ball create a turbulent boundary layer around the ball, i.e., the air in a thin layer adjacent to the ball flows in a turbulent manner. The turbulence energizes the boundary layer and helps it remain attached further around the ball to reduce the area of the wake. This greatly increases the average pressure behind the ball and substantially reduces the drag.

Lift is the upward force on the ball that is created from a difference in pressure between the top of the ball and the bottom of the ball. The difference in pressure is created by a warpage in the air flow resulting from the ball's back spin. Due to the back spin, the top of the ball moves with the air flow, which delays the separation to a point further aft. Conversely, the bottom of the ball moves against the air flow, moving the separation point forward. This asymmetrical separation creates an arch in the flow pattern, requiring the air over the top of the ball to move faster, and thus have lower pressure than the air underneath the ball.

Most golf ball manufacturers research dimple patterns in order to increase the distance traveled by a golf ball. A high degree of dimple coverage is beneficial to flight distance, but dimple coverage gained by filling spaces between normally sized dimples with tiny dimples is not very effective because tiny dimples are not good turbulence generators. Most balls today have many large spaces between dimples, or have filled these spaces with very small dimples that do not create enough turbulence at average golf ball velocities.

Low drag, low lift dimples are generally smaller than in common golf balls and cover a large area of the surface of the golf ball. Such dimples are taught, for example, in U.S. Pat. No. 4,560,168. This patent teaches a variety of dimple patterns for golf balls. The dimple pattern is obtained by dividing the spherical surface of the golf ball into twenty spherical triangles corresponding to the faces of a regular icosahedron. Each of the twenty triangles is further divided into four smaller triangles: one central triangle and three apical triangles at the three apexes of the larger triangle. This is done by connecting the midpoints of the sides or edges of the larger triangle by great circle paths. The dimples are arranged in each central triangle and each apical triangle such so that no dimples intersect the edges of the central triangle. The patent states that the size, numbering, and configuration of the dimples should be selected to optimize aerodynamic performance and minimize bald patches.

A golf ball with an improved ballistic, as opposed to aerodynamic, trajectory is needed to improve play for low swing-speed golfers.

SUMMARY OF THE INVENTION

The golf ball of the present invention provides improved distance to golf players whose swing speed is too low to produce sufficient lift to take advantage of aerodynamic flight. The ball exhibits improved ballistic flight.

This improved flight is achieved by reducing the coefficient of drag of the ball to below about 0.26 at a spin rate of 3000 rpm and a Reynolds number of about 150,000, which corresponds to a ball velocity of about 170 fps, and by reducing the weight of the ball to below about 1.60 oz. Reducing the weight of the ball improves initial velocity and distance at low launch velocities.

The dimple pattern selected for the golf ball is the primary factor in reducing the coefficient of drag of the golf ball. The golf ball of the present invention employs low-drag dimples, which cover a large fraction of the exterior surface of the ball. The preferred embodiments have dimples covering at least about 70% of the exterior cover surface. Also, the number of dimples on the golf ball surface is preferably large to minimize drag. Preferably, the golf ball has at least about 440 dimples, and most preferably about 650.

Reducing spin on the ball also reduces the amount of energy that becomes transferred to lifting the ball, and retains more energy in translating the ball forward. The preferred golf ball constructed according to the invention launches at a spin rate of less than about 3000 rpm, which is considered a low spin rate, when struck under the launch conditions set forth in the ODS test established by the USGA.

DETAILED DESCRIPTION OF THE PREFERRED EMBODIMENTS

Figure 1:
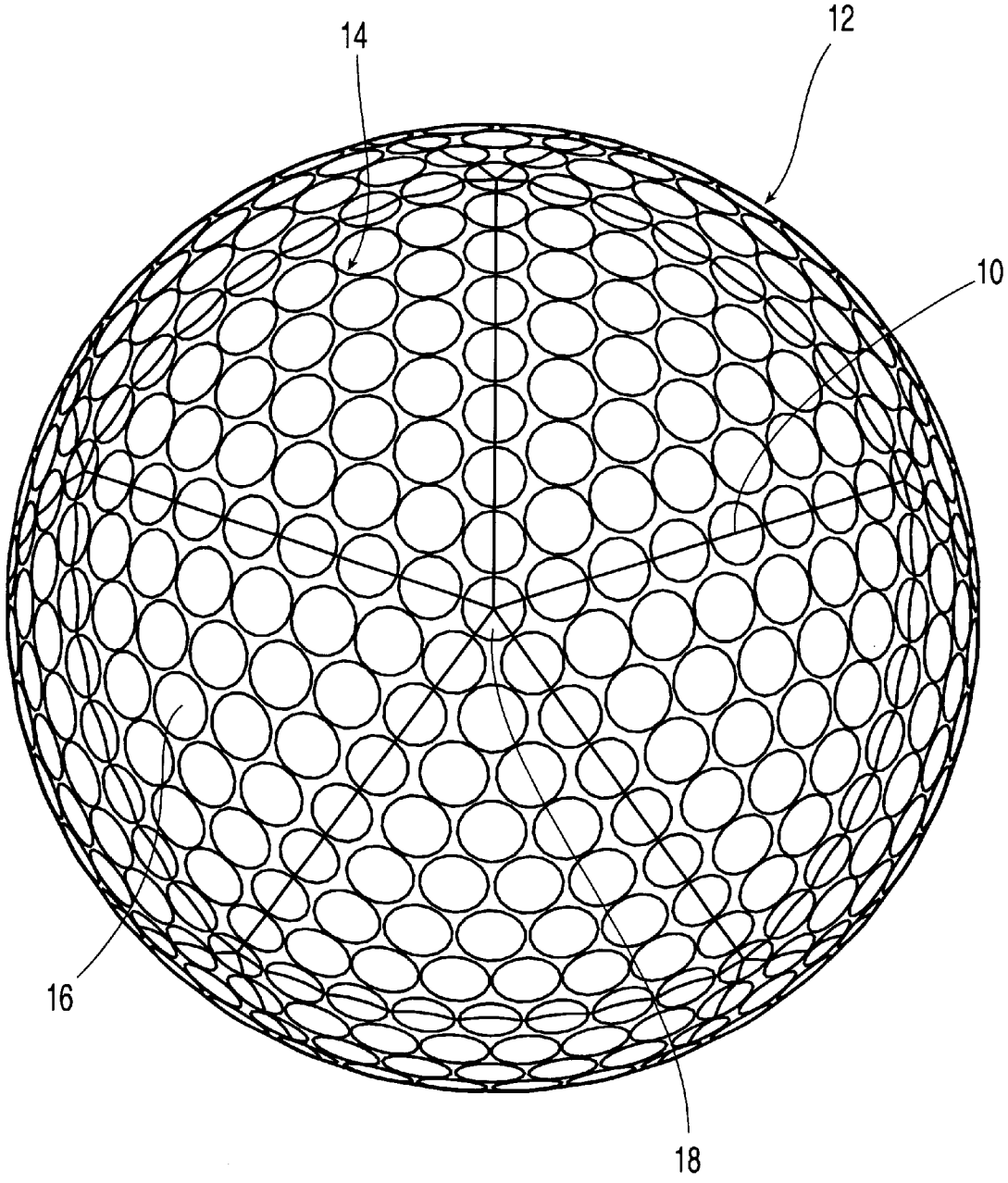
FIG. 1 is a perspective view of a golf ball according to the invention.
Figure 2:
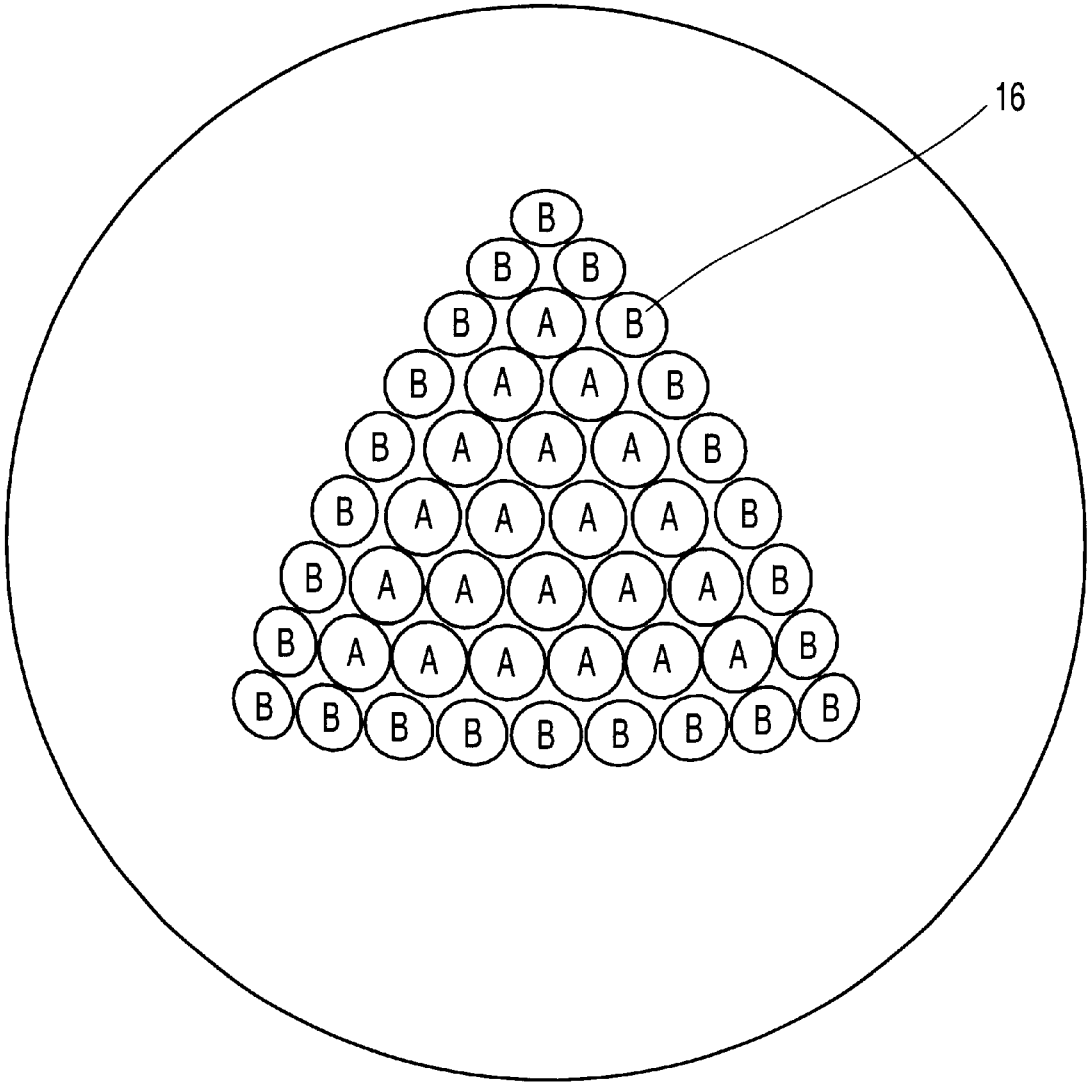
FIGS. 2 and 3 are detailed views of the dimple pattern of the golf ball of FIG. 1.
Figure 3:
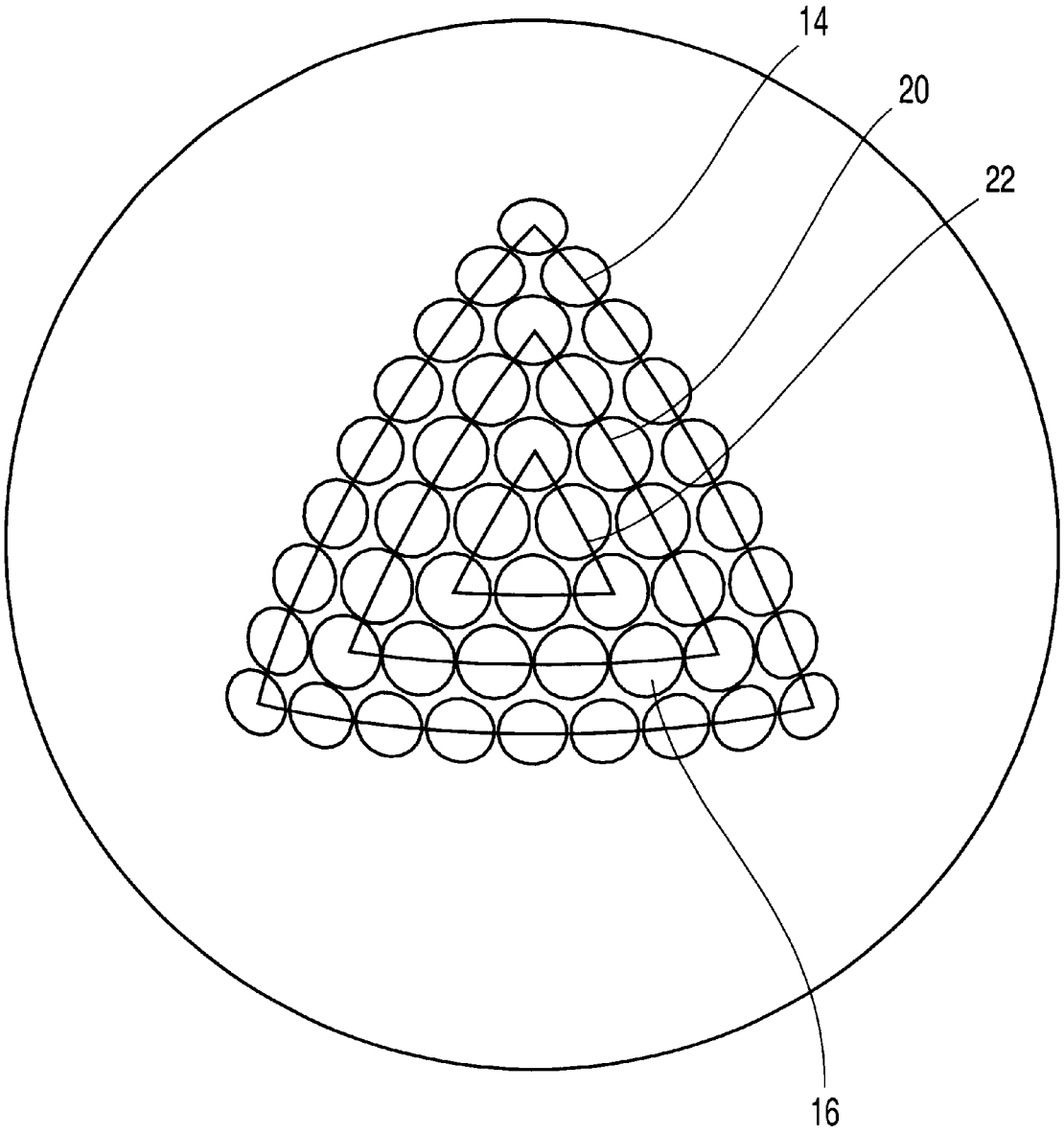

Referring to FIGS. 1–3, solid lines 10 shown in FIG. 1 on golf ball 12 form twenty icosahedral spherical triangles 14, which correspond to faces of a regular icosahedron. The golf ball 12 has a pattern of dimples 16 that is substantially repeated in each icosahedral triangle 14. The icosahedron pattern has five triangles 14 formed at both the top and bottom of the ball 12. Each of the five triangles 14 shares a vertex dimple 18. There are also ten triangles 14 that extend around the middle of the ball 12.

FIGS. 2–3 provide the detailed layout of one of the triangles 14 of FIG. 1. This dimple pattern has 642 dimples 16. The pattern includes dimples 16 of sizes A and B formed in concentric triangles 14, 20, and 22. Dimples B, disposed along the edges of the icosahedral triangle 14, have a smaller diameter than dimples A, which are disposed centrally within the icosahedral triangle 14, along the edges of triangles 20 and 22.

Each of the edges of triangles 14 and 22 has an odd number of dimples 16, and each of the edges of triangle 20 has an even number of dimples 16. Each triangle 14 and 20 has nine more dimples 16 on its edges than its respective adjacent, smaller triangle 20 and 22. The large triangle 14 has a total of nine more dimples 16 on its edges than middle triangle 20, and middle triangle 20 has nine more dimples 16 than small triangle 22.

This creates a hexagonal packing in which almost all dimples 16 are surrounded by six other dimples 16. Preferably at least 75% of the dimples 16 have six adjacent dimples 16. More preferably, only the vertex dimples do not have hexagonal packing.

Figure 4:
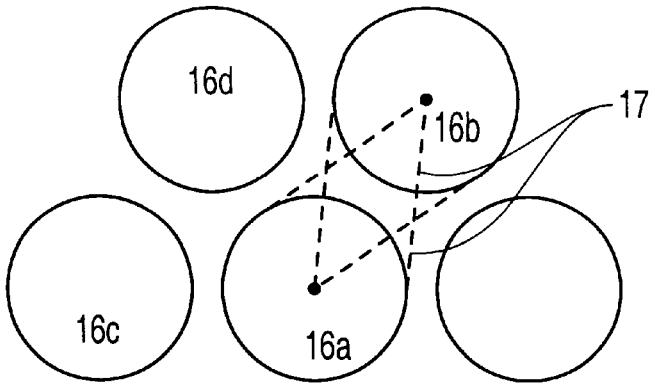
FIGS. 4 and 5 are views of dimples on a golf ball.
Figure 5:
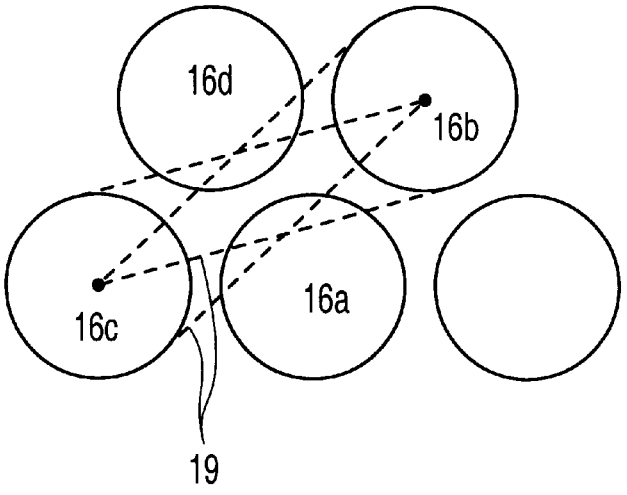

For purposes of this application, as shown in FIG. 4, any two dimples 16, such as dimples 16*a* and 16*b*, are considered adjacent where four line segments 17, including two lines segments 17 drawn from a point tangent to each dimple 16*a* and 16*b* to the center of the other dimple 16*a* and 16*b*, do not intersect any other dimple 16. Dimples 16*b* and 16*c*, however, are not adjacent, as shown in FIG. 5, as at least one of line segments 19, extending tangent to one of the dimples 16*b* and 16*c* to the center of the other dimple 16*b* and 16*c*, intersects another dimple 16*a* or 16*d*. Also, dimples with edges within about 0.03 inches of one another are also considered adjacent. For simplicity, the examples of FIGS. 4 and 5 show the dimples lying on a flat surface, but it is understood that dimples on a ball lie on a spherically curved surface, and line segments 17 and 19 extend along great circle arcs.

Preferably, in the golf balls according to the present invention, less than 30% of the spacings between adjacent dimples 16 are greater than 0.01 inches. More preferably, less than 15% of the spacings between adjacent dimples 16 is greater than 0.01 inches.

In the golf ball shown in FIGS. 1–3, there is no great circle path that is does not intersect any dimples 16. This increases the percentage of the outer surface that is covered by dimples 16. Golf balls according to the present invention preferably have dimples 16 arranged so that there are less than four great circle paths that do not intersect any dimples 16. There is more preferably no great circle path, or only one great circle path at the equator, that does not intersect any dimples 16.

Providing one equator that does not intersect any dimples 16 facilitates manufacturing, however, in particular the step of buffing golf balls after molding. Also, many players prefer to have an equator that they can use to line up putts. Thus, dimple patterns often have modified triangles 14 around the mid-section to create the equator that does not intersect any dimples 16.

Figure 6:
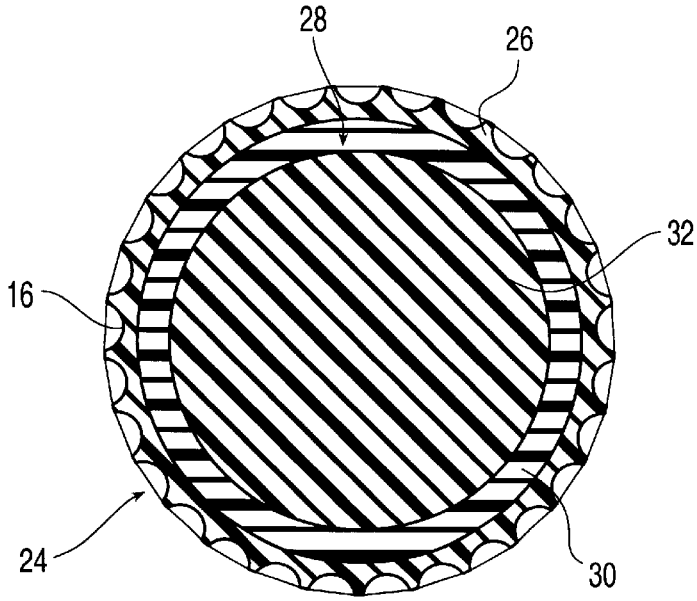
FIG. 6 is a cross-sectional view of a golf ball according to the invention.

FIG. 6 diagrammatically illustrates a cross-section of a golf ball 24. Golf ball 24 has a pattern of dimples 16 formed on the exterior surface of a cover 26. The cover 26 surrounds a core 28, and in the embodiment shown, the core 28 includes a mantle layer 30 and a center 32, however, additional mantle layers or cover layers may also be used. In a one piece alternative embodiment, the cover 26 and the core 28 are made from a single piece of material.

Figure 7:
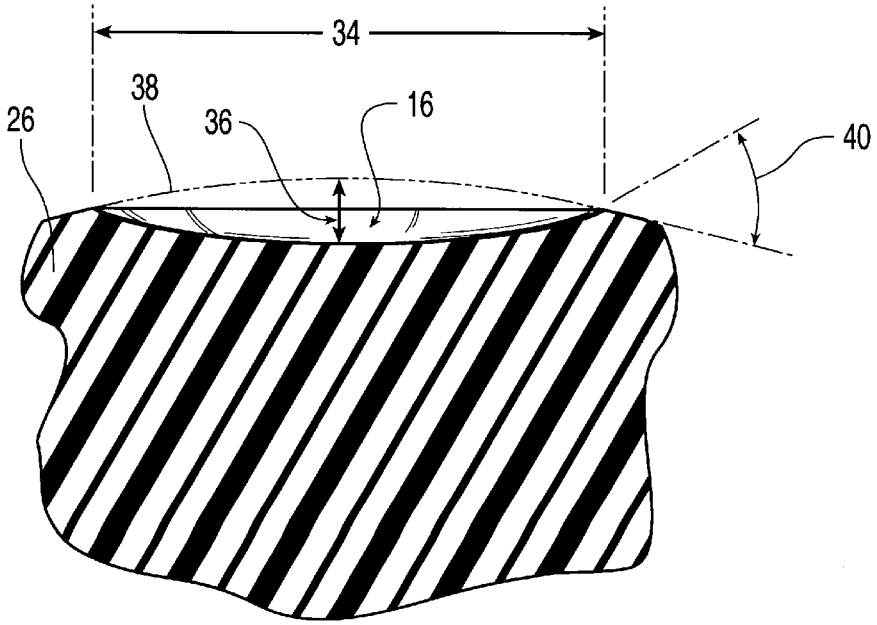
FIG. 7 is a cross-sectional view of a dimple of the golf ball of FIG. 6.

Referring to FIG. 7, each dimple 16 has a frustospherical shape. The diameter 34 and depth 36, which is measured from the deepest point of the dimple 16 to the perimeter of a phantom sphere 38 that has the diameter of the golf ball 24, can be plainly seen. Dimples A of FIGS. 1–3 preferably have a diameter of about 0.12 inches, and dimples B preferably have a diameter of about 0.11 inches. In the preferred embodiment, there are 420 dimples A and 222 dimples B. Together, the dimples 16 cover about 77% of the golf ball 12.

The walls of the dimple 16, where they meet the undimpled portion of the exterior surface, are formed at an edge angle 40 tangential to this undimpled portion. Edge angle 40 is preferably between about 10° and 18°, and most preferably about 13°.

Since the depth 36 and diameter 34 of the dimples 16 can be used to calculate the total dimple volume for a particular golf ball, the low-drag dimples 16 of the present invention can also be described by the total dimple volume they enclose between the exterior surface of the cover 26 and the phantom sphere 38.

Figure 8:
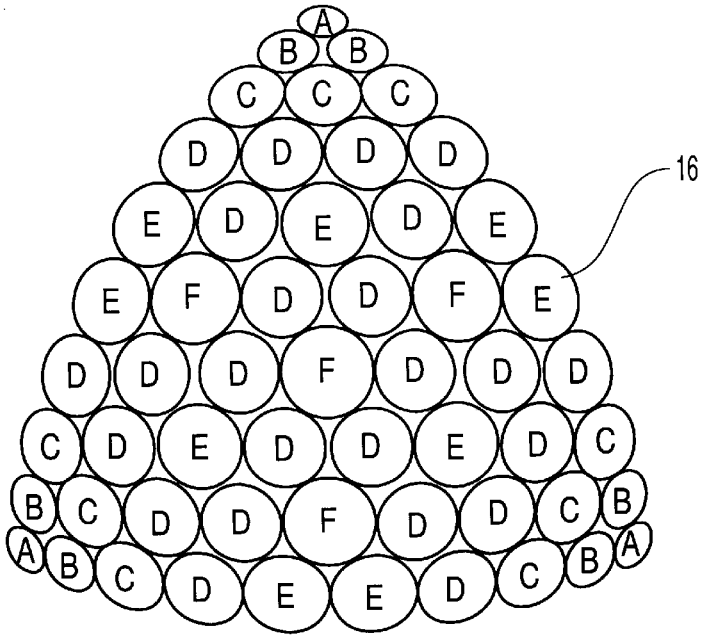
FIGS. 8 and 9 are detailed views of an alternative dimple pattern.
Figure 9:
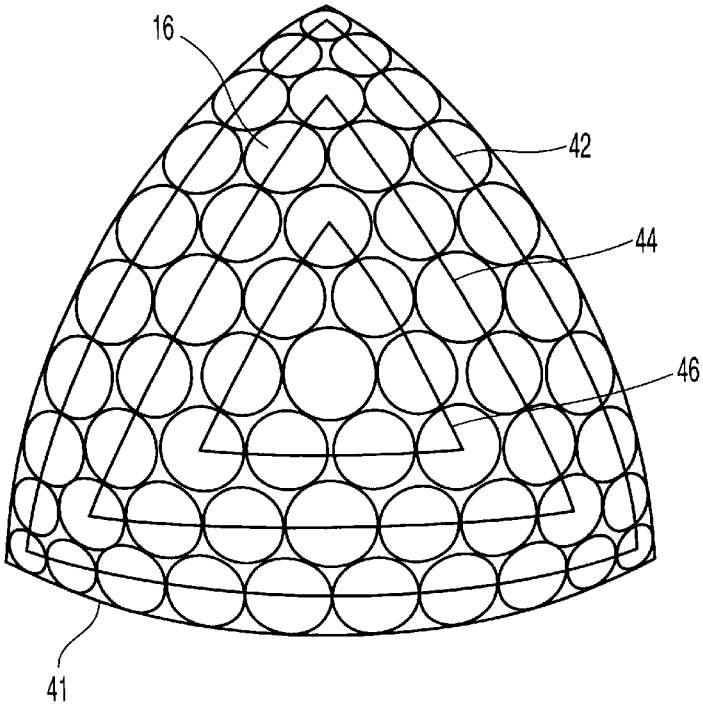

Referring to FIGS. 8–9, another suitable, low-drag dimple pattern is formed on a golf ball divided into eight triangles on the surface of the cover, in an octahedral pattern, with the dimples 16 being inside the octahedral triangle 41 shown. This golf ball dimple pattern embodiment has 440 dimples 16 of six different sizes.

The dimples 16 are formed in large triangles 42, middle triangles 44, and small triangles 46. In this embodiment, each of the edges of the large triangle 42 has an even number of dimples 16, each of the edges of the middle triangle 44 has an odd number of dimples 16, and each of the edges of the small triangle 42 has an even number of dimples 16. The large triangle 42 has nine more dimples 16 than the middle triangle 44, and the middle triangle 44 has nine more dimples 16 than the small triangle 46. This creates a hexagonal packing for all of the dimples 16 inside the large triangles 42, increasing dimple coverage of the exterior surface of the ball.

In this embodiment, the diameters of the dimples of the different sizes are as follow:

| Dimple | A | B | C | D | E | F |
|---|---|---|---|---|---|---|
| Diameter (in.) | .09 | .11 | .14 | .15 | .16 | .17 |

The above dimple sizes render a surface coverage of about 82%.

The preferred low-drag dimple patterns in this invention further have dimples 16 that cover at least about 70% of the exterior surface of the ball, and more preferably at least about 80% of the exterior surface of the ball.

In golf balls constructed according to the invention, most of the dimples 16 preferably have a diameter of up to about 0.15 inches. More preferably, at least about 70% of the dimples 16 have a diameter of about 0.13 inches or less, and about 100% of the dimples 16 have a diameter of about 0.15 inches or less.

In terms of drag coefficient, whereas at professional launch speeds a golf ball with around 400 dimples produces the lowest coefficient of drag, it has been found that at a spin rate of about 3000 rpm and a Reynolds number of about 150,000, which corresponds to a launch speed of about 170 fps, the lowest drag coefficient is achieved with a golf ball that has about 650 dimples. The coefficient of drag achieved with this number of dimples is slightly above 0.25. At even slower launch speeds, a higher number of dimples is preferred. For example, at a Reynolds number of about 120,000, about 800 dimples provide the least drag.

As the golf balls of the invention are tailored to improve the distance achieved by low swing-speed players, these golf balls preferably have a coefficient of drag of less than about 0.26 at a Reynolds number of 150,000 and a spin rate of 3000 rpm. Also, at a Reynolds number of about 130,000, the golf balls preferably have a drag coefficient of less than about 0.28, and more preferably of less than 0.27. At a Reynolds number of 120,000, the golf balls preferably have a coefficient of drag of less than about 0.29, and more preferably less than about 0.28.

Preferably, the golf ball has at least about 440 dimples. More preferably, the golf ball has above about 500 dimples, and most preferably between about 550 and about 700 dimples. Golf balls tailored to even lower swing speeds may have 800 dimples or more.

Furthermore, the preferred embodiment has a low-spin construction in order to minimize lift and the amount of energy converted to lift instead of forward motion. The embodiments of this invention may be of solid construction, as shown in FIG. 6; wound construction, in which the mantle layer 30 can be replaced with tightly wound rubber windings; or any other type of construction known in the art. The cover 26 shown in FIG. 6 has a single layer, but may include additional layers. Similarly, the core 28 shown has two layers, but may instead include only a center or multiple mantle layers.

A low spin-rate is achieved by providing a hard cover 26 and a soft core 28. A wide variety of cover materials may be used in the present invention. Among the preferred conventional cover materials are ionomer resins. More particularly, blends of ionomers, including acid-containing olefin copolymer ionomers, are preferred. These ionomers are copolymers of an olefin such as ethylene and an alpha, beta-unsaturated carboxylic acid such as acrylic or methacrylic acid present in 5–35 (preferably 10–35, most preferably 15–20) weight percent of the polymer, wherein the acid moiety is neutralized 1%–90% (preferably at least 40%, most preferably at least about 60%) to form an ionomer by a cation such as lithium, sodium, potassium, magnesium, calcium, barium, lead, tin, zinc or aluminum, or a combination of such cations, lithium, sodium and zinc being the most preferred. Specific acid-containing ethylene copolymers include ethylene/acrylic acid, ethylene/methacrylic acid, ethylene/acrylic acid/n-butyl acrylate, ethylene/methacrylic acid/n-butyl acrylate, ethylene/methacrylic acid/iso-butyl acrylate, ethylene/acrylic acid/iso-butyl acrylate, ethylene/methacrylic acid/n-butyl methacrylate, ethylene/acrylic acid/methyl methacrylate, ethylene/acrylic acid/methyl acrylate, ethylene/methacrylic acid/methyl acrylate, ethylene/methacrylic acid/methyl methacrylate, and ethylene/acrylic acid/n-butyl methacrylate. Preferred acid-containing ethylene copolymers include ethylene/methacrylic acid, ethylene/acrylic acid, ethylene/methacrylic acid/n-butyl acrylate, ethylene/acrylic acid/n-butyl acrylate, ethylene/methacrylic acid/methyl acrylate and ethylene/acrylic acid/methyl acrylate copolymers. The most preferred acid-containing ethylene copolymers are ethylene/methacrylic acid, ethylene/acrylic acid, ethylene/(meth)acrylic acid/n-butyl acrylate, ethylene/(meth)acrylic acid/ethyl acrylate, and ethylene/(meth)acrylic acid/ethyl acrylate ad. ethylene/(meth) acrylic acid/methyl acrylate copolymers.

The manner in which these ionomers are made is well known in the art as described in U.S. Pat. No. 3,262,272, for example. A preferred cover is comprised of a blend of ionomer resins that are copolymers of 80% to 95% of an olefin such as ethylene and about 13%–16% by weight of an alpha, beta-unsaturated carboxylic acid, wherein about 10%–90% of the carboxylic acid groups are neutralized with a metal ion. Preferably, a first ionomer is neutralized with lithium and a second ionomer is neutralized with sodium. Preferably, the blend comprises between 10% and 65% of the lithium ionomer and between 90% and 45% of the sodium ionomer. Most preferably, the blend is a 50/50 blend. Suitable ionomers include SURLYN® 8140, which is a sodium ionomer that has greater than 16% by weight of an alpha, delta-unsaturated carboxylic acid; SURLYN® 9910, which is a zinc SURLYN® that has about 15% by weight of an alpha, delta-unsaturated carboxylic acid; and SURLYN® 7940, which is a standard lithium ionomer. Still further, the preferred cover has a hardness of greater than about 60 shore D and a flexural modulus of between about 60 and 70 ksi. The high flexural modulus of the cover 26 not only lowers the spin rate, but also can provide increased initial velocity, further benefitting a low swing-speed player. Other useful SURLYN® ionomers include SURLYN® 8118 and SURLYN® 7930, which have flexural moduli of about 61 ksi.

Soft cores produce low spin rates. The core 28 has a reduced compression to slow the ball's spin and reduce lift and drag. Preferably, the compression of the core 28 is below about 90 points. If the compression of the ball as a whole drops too far, however, the initial velocity may decrease excessively.

As used herein, the terms "points" or "compression points" refer to the standard compression scale based on the ATTI Engineering Compression Tester. This scale, which is well known to those working in this field, is used in determining the relative compression of a core or ball and has been referred to as PGA compression.

Zinc oxide (ZnO) in the core 28 may be reduced or eliminated in favor of calcium oxide (CaO). Such a composition can maintain the initial velocity of the ball near or even above the maximum allowed by the USGA, while reducing the compression of the core 28 by at least about 2 compression points to as much as about 14 points. Where the amount of zinc oxide traditionally incorporated in cores is typically about 5 to 50 pph of polybutadiene, the amount of calcium oxide preferably added to the core-forming composition of the invention as an activator is typically in the range of about 0.1 to 15, and most preferably 1.25 to 5 pph. A wound construction of the core may also be employed to increase the initial velocity of the ball.

The construction of the golf ball is preferably selected such that when the ball is struck squarely by a golf club head moving at the speed of about 160 fps with a dynamic loft angle of about 10°–12°, the ball achieves a spin rate of less than about 3000 rpm, which is considered a low spin rate. More preferably, the spin rate achieved under these strike conditions is between 2000 and 2800 rpm, and most preferably the ball achieves a spin rate below about 2600 rpm. The spin rate is preferably above 2000 rpm, as spin rates much below 2000 rpm tend to produce unstable airflow patterns, resulting in unpredictable ball flight. As these strike conditions are used in the ODS test, these spin rates can be described in terms of the spin achieved under ODS strike conditions.

Golf balls according to the present invention have a weight reduced from the normal. This increases the initial velocity of the golf ball and further improves the distance covered by the ball when struck by a low swing-speed player. Generally, fillers are added to golf ball cores in order to control the weight of the ball and bring the ball mass up to the maximum specified by the USGA. Useful fillers include zinc oxide, barium sulfate, and regrind, which is recycled core molding scrap ground to 30 mesh particle size.

The preferred weight of golf balls according to the invention is below about 1.60 oz, more preferably between about 1.5 oz. and 1.6 oz., and most preferably between about 1.55 oz. and 1.56 oz. It is preferred that a reduction in core mass be accomplished by reducing the amount of fillers that are added when compared to a USGA regulation ball. Also, any filler can be added in a manner such that ball density increases with distance from the geometric center of the golf ball to increase the rotational moment of inertia of the golf ball to lower the spin of the ball when it is hit.

Typical golf balls with solid polybutadiene cores 28 have a specific gravity of about 1.25. Golf balls of the present invention are preferably comprised of low weight polybutadiene with a specific gravity of less than the standard 1.25.

In balls with liquid centers, a mixture of corn syrup, salt and water may be employed as the liquid. Corn syrup and salt are added to increase the specific gravity and viscosity. A low center density is desirable, however, to minimize weight. Low-weight liquid centers are preferred and may use water only or a Barium Sulfate ($BaSO_4$) paste.

It will be appreciated that numerous modifications to the embodiments described above and other embodiments, such as golf balls with tetrahedral dimple patterns, may be devised by those skilled in the art. Therefore, the appended claims are intended to cover all modifications and embodiments which come within the spirit and scope of the present invention.

What is claimed:

1. A golf ball comprising:

(a) a core; and (b) a cover surrounding the core and having an exterior surface defining at least 500 dimples which cover at least 77% of the exterior surface, wherein less than about 24% of the dimples have a diameter of about 0.16 inches or greater, such that the golf ball has a coefficient of drag below 0.26 at a Reynolds number of 150,000 and a spin rate of 3000 rpm;

wherein the cover and the core are made from materials selected such that the golf ball has a weight of below 1.60 oz.

2. The golf ball of claim 1, wherein the weight of the ball is between 1.5 and 1.6 oz.

3. The golf ball of claim 2, wherein the weight of the ball is 1.55 oz.

4. The golf ball of claim 1, wherein the materials of the core and the cover are selected and configured such that the ball launches at a spin rate of less than 3000 rpm when struck under the conditions set forth in the Overall Distance Standard for golf balls established by the United States Golf Association.

5. The golf ball of claim 4, wherein the materials of the core and the cover are selected and configured such that the ball launches at a spin rate of less than 2800 rpm when struck under the conditions set forth in the Overall Distance Standard for golf balls established by the United States Golf Association.

6. The golf ball of claim 4, wherein:

(a) the core has a compression of below 90 points; and (b) the cover has a hardness of greater than 60 shore D.

7. The golf ball of claim 6, wherein the core comprises polybutadiene and from 1 to 10 parts by weight of calcium oxide per hundred parts of polybutadiene.

8. The golf ball of claim 1, wherein the core includes a layer including rubber windings.

9. The golf ball of claim 1, further comprising a spacing between adjacent dimples, wherein less than 30% of the spacing between adjacent dimples is at least 0.01 inches.

10. The golf ball of claim 1, wherein the dimples have an edge angle of 10° to 18° to a phantom sphere concentric with and having a same diameter as the exterior surface of the cover.

11. The golf ball of claim 1, wherein less than 7% of the dimples have a diameter of 0.17 inches or greater.

12. A golf ball comprising:

(a) a core; and (b) a cover surrounding the core and having an exterior surface defining at least 440 dimples which cover at least 77% of the exterior surface, wherein less than about 24% of the dimples have a diameter of about 0.16 inches or greater, such that the golf ball has a coefficient of drag below 0.26 at a Reynolds number of 150,000 and a spin rate of 3000 rpm;

wherein the core and the cover are made from materials selected such that the golf ball has a weight of below 1.60 oz.

13. The golf ball of claim 12, further comprising a spacing between adjacent dimples, wherein less than 30% of the spacing between adjacent dimples is at least 0.01 inches.

14. A golf ball comprising:

(a) a core; and (b) a cover having an exterior surface defining at least 440 dimples which cover at least 77% of the exterior surface, and less than 24% of the dimples have a diameter of 0.16 inches or greater;

(c) a spacing between adjacent dimples, wherein less than 30% of the spacing between adjacent dimples is at least 0.01 inches;

wherein the core and the cover are made from materials selected such that the golf ball has a weight of below 1.60 oz.

15. The golf ball of claim 14, wherein the golf ball has a coefficient of drag below 0.28 at a Reynolds number of 130,000 and a spin rate of 3000 rpm.

16. The golf ball of claim 14, wherein the golf ball has a coefficient of drag below 0.29 at a Reynolds number of 120,000 and a spin rate of 3000 rpm.

17. The golf ball of claim 14, wherein the exterior surface defines at least 550 of said dimples.

18. The golf ball of claim 17, wherein the exterior surface defines less than 700 of said dimples.

19. The golf ball of claim 17, wherein the exterior surface defines 650 of said dimples.

20. The golf ball of claim 14, wherein the dimples cover at least 80% of the exterior surface.

21. The golf ball of claim 14, wherein the dimples are arranged such that no more than one great circle path free from dimples is defined on the exterior surface.

22. The golf ball of claim 14, wherein the dimples have an edge angle of 13° to a phantom sphere concentric with and having a same diameter as the exterior surface of the cover.

23. The golf ball of claim 14, wherein the materials of the core and the cover are selected and configured such that the ball launches at a spin rate of less than 3000 rpm when struck under the conditions set forth in the Overall Distance Standard for golf balls established by the United States Golf Association.

24. The golf ball of claim 14, wherein the material of the core and the cover are selected and configured such that the ball launches at a spin rate of less than 2800 rpm when struck under the conditions set forth in the Overall Distance Standard for golf balls established by the United States Golf Association.

25. The golf ball of claim 14, wherein the golf ball has a coefficient of drag below 0.28 at a Reynolds number of 130,000 and a spin rate of 3000 rpm.

26. The golf ball of claim 14, wherein the golf ball has a coefficient of drag below 0.29 at a Reynolds number of 120,000 and a spin rate of 3000 rpm.

* * * * *